US009956807B2

(12) United States Patent
Staub et al.

(10) Patent No.: US 9,956,807 B2
(45) Date of Patent: May 1, 2018

(54) MULTI-LAYER BODY AND METHOD FOR THE PRODUCTION THEREOF

(71) Applicants: LEONHARD KURZ Stiftung & Co. KG, Furth (DE); OVD Kinegram AG, Zug (CH)

(72) Inventors: Rene Staub, Hagendorn (CH); Ludwig Brehm, Adelsdorf (DE); Patrick Kramer, Lauf (DE); Rouven Spiess, Unterageri (CH); Karin Forster, Oberasbach (DE)

(73) Assignees: LEONHARD KURZ STIFTUNG & CO. KG, Furth (DE); OVD KINEGRAM AG, Zug (CH)

( * ) Notice: Subject to any disclaimer, the term of this patent is extended or adjusted under 35 U.S.C. 154(b) by 51 days.

(21) Appl. No.: 15/038,874

(22) PCT Filed: Nov. 28, 2014

(86) PCT No.: PCT/EP2014/075928

§ 371 (c)(1),
(2) Date: May 24, 2016

(87) PCT Pub. No.: WO2015/079017

PCT Pub. Date: Jun. 4, 2015

(65) Prior Publication Data

US 2017/0028765 A1 Feb. 2, 2017

(30) Foreign Application Priority Data

Nov. 29, 2013 (DE) ..... 10 2013 113 283

(51) Int. Cl.
*B42D 25/445* (2014.01)
*B42D 25/29* (2014.01)
(Continued)

(52) U.S. Cl.
CPC ..... *B42D 25/445* (2014.10); *B42D 25/29* (2014.10); *B42D 25/324* (2014.10);
(Continued)

(58) Field of Classification Search
None
See application file for complete search history.

(56) References Cited

U.S. PATENT DOCUMENTS 7,821,716 B2 10/2010 Staub et al.
2007/0095224 A1 5/2007 Brehm et al.
(Continued)

FOREIGN PATENT DOCUMENTS

CN 101516634 8/2009
CN 102056748 5/2011
(Continued)

*Primary Examiner* — Shamim Ahmed
(74) *Attorney, Agent, or Firm* — Hoffmann & Baron, LLP

(57) ABSTRACT

The invention relates to a method for producing a multi-layer body, in particular a security element, in which a partial first layer or partial first layer system is produced on a substrate, wherein the partial first layer or partial first layer system is present in a first partial area and not in a second partial area. Subsequently, a partial second layer or partial second layer system is produced, wherein the partial second layer or partial second layer system is present in a third partial area and not in a fourth partial area, and wherein the third partial area overlaps with the first and second partial areas. Finally, the partial first layer or partial first layer system is structured as a mask using the partial second layer or partial second layer system.

25 Claims, 10 Drawing Sheets

(51) Int. Cl.

| | |
|---|---|
| ***B42D 25/405*** | (2014.01) |
| ***B42D 25/415*** | (2014.01) |
| ***B42D 25/43*** | (2014.01) |
| ***B42D 25/45*** | (2014.01) |
| ***B42D 25/324*** | (2014.01) |
| ***B42D 25/328*** | (2014.01) |
| ***B42D 25/364*** | (2014.01) |
| ***B42D 25/373*** | (2014.01) |
| ***B42D 25/378*** | (2014.01) |

(52) U.S. Cl.
CPC ..... *B42D 25/328* (2014.10); *B42D 25/364* (2014.10); *B42D 25/373* (2014.10); *B42D 25/378* (2014.10); *B42D 25/405* (2014.10); *B42D 25/415* (2014.10); *B42D 25/43* (2014.10); *B42D 25/45* (2014.10)

(56) References Cited

U.S. PATENT DOCUMENTS

| | | | | |
|---|---|---|---|---|
| 2007/0296037 | A1 | 12/2007 | Dozen et al. | |
| 2008/0088895 | A1* | 4/2008 | Argoitia | C09J 11/02 359/2 |
| 2008/0246158 | A1 | 10/2008 | Mascolo et al. | |
| 2009/0317595 | A1 | 12/2009 | Brehm et al. | |
| 2010/0109317 | A1 | 5/2010 | Hoffmuller et al. | |
| 2011/0091665 | A1 | 4/2011 | Heim | |
| 2011/0127762 | A1 | 6/2011 | Hoffmuller et al. | |
| 2012/0064303 | A1 | 3/2012 | Yashiki et al. | |
| 2012/0156446 | A1 | 6/2012 | Brehm et al. | |
| 2012/0189159 | A1 | 7/2012 | Vincent | |

FOREIGN PATENT DOCUMENTS

| | | |
|---|---|---|
| CN | 102177033 | 9/2011 |
| CN | 102460236 | 5/2012 |
| CN | 102574411 | 7/2012 |
| DE | 10333255 | 1/2005 |
| DE | 102007007914 | 8/2008 |
| GB | 2464496 | 4/2010 |
| WO | WO2006084685 | 8/2006 |
| WO | WO2009053673 | 4/2009 |

* cited by examiner

MULTI-LAYER BODY AND METHOD FOR THE PRODUCTION THEREOF

This application claims priority based on an International Application filed under the Patent Cooperation Treaty, PCT/EP2014/075928, filed on Nov. 28, 2014, and German Application No. DE 102013113283.9, filed on Nov. 29, 2013.

BACKGROUND OF THE INVENTION

The invention relates to a multi-layer body with two layers or layer systems and to a method for the production thereof.

Multi-layer bodies as a security element can be taken as known from the prior art and are widely used to protect bank notes, securities and identity documents against forgery or for the authentication of products. They are based on a combination of several functional layers, which may, for example, comprise optically variable elements (OVD=Optical Variable Devices), diffractive elements, partially metalized layers or printed features.

It is known to produce such multi-layer bodies by the sequential application of individual layers, building up the desired layer sequence. In order to obtain multi-layer bodies that are particularly forgery-proof, it is desirable to allow features of the individual layers to blend seamlessly into one another. In other words, the layers should be arranged as accurately as possible in register with one another. Where the multi-layer bodies are built up sequentially, however, this cannot always be achieved since the methods used to produce each individual layer are subject to tolerances in terms of the position of the layers relative to one another. As a result, the desired seamless transitions between the features cannot be achieved reliably, which has a negative effect on the anti-forgery security and the optical appearance of such a multi-layer body.

By register or register accuracy is meant the accurately positioned arrangement of superimposed layers relative to one another, maintaining a desired positional tolerance.

SUMMARY OF THE INVENTION

The object of the present invention is therefore to provide a method for producing a multi-layer body that makes it possible to produce a multi-layer body with improved anti-forgery security. It is a further object of the present invention to provide a particularly forgery-proof multi-layer body.

This object is achieved by a method with the features of claim 1 and by a multi-layer body with the features of claim 26.

Such a method for producing a multi-layer body, in particular a security element, comprises the following steps:

a) producing a partial first layer or partial first layer system on a substrate, wherein the partial first layer or partial first layer system is present in a first partial area and not in a second partial area;

b) producing a partial second layer or partial second layer system, wherein the partial second layer or partial second layer system is present in a third partial area and not in a fourth partial area, and wherein the third partial area overlaps with the first and second partial areas;

c) structuring the partial first layer or partial first layer system using the partial second layer or partial second layer system as a mask.

In this way, a multi-layer body, in particular a security element, is obtained which comprises a substrate, a partial first layer or partial first layer system as well as a partial second layer or partial second layer system, wherein the partial first layer or partial first layer system is structured accurately in register with the partial second layer or partial second layer system using the partial second layer or partial second layer system as a mask and wherein the partial first layer or partial first layer system is present in a first partial area and not in a second partial area and wherein the partial second layer or partial second layer system is present in a third partial area and not in a fourth partial area, and wherein the third partial area overlaps with the first and second partial areas.

By using the partial second layer or partial second layer system as a mask in order to structure the partial first layer or partial first layer system, it is possible to arrange the two layers or layer systems exactly in register with one another. It is of particular importance that the second partial layer or second partial layer system extends not only into those areas covered by the first partial layer or first partial layer system—i.e. the first partial area—but also into the areas not covered by the first partial layer or first partial layer system—i.e. the second partial area. By use of the second partial layer or second partial layer system as a mask is meant here that, during the structuring of the first partial layer or first partial layer system, the latter is either selectively retained in or selectively removed from those areas that are covered by the second partial layer or second partial layer system. During the structuring, therefore, a defined positional relationship between the two layers or layer systems is obtained, so that these are arranged accurately in register with one another, for example adjoining one another seamlessly.

By layer system is meant here any arrangement of several layers. The layers can be arranged one on top of another in the direction of the surface normals of the layer system or also next to one another in a plane. A combination of layers arranged horizontally and vertically in this way is also possible.

By overlapping is meant that the respective partial areas lie at least partially one on top of another in the direction of the surface normals of the planes spanned by the first or second layer, i.e. viewed in the stack direction of the multi-layer body.

The production of the two layers or layer systems does not have to take place in the specified order, i.e. the second partial layer or second partial layer system can also be produced before the first partial layer or first partial layer system. The layers or layer systems can be produced directly on the substrate, directly on top of one another or with the production of any intermediate layers.

The structuring of the partial first layer or partial first layer system in step c) preferably takes place by etching. It is expedient if the partial second layer or partial second layer system is an etch resist or comprises an etch resist.

By an etch resist is meant a substance that is resistant to an etching agent and which can protect a substance that is sensitive to the etching agent from attack by the etching agent where the etch resist covers this substance.

In this embodiment, after production of the two layers or layer systems, an etching agent is therefore applied to the resulting layer stack, which etching agent removes the first partial layer or first partial layer system where this is not covered by the second partial layer or second partial layer system.

The etch resist is preferably a lacquer, which can in particular comprise binders, dyes, pigments, in particular colored or non-colored pigments, special-effect pigments, thin-film systems, cholesteric liquid crystals and/or metallic or non-metallic nanoparticles. Thus, the second partial layer or second partial layer system not only performs a protective function in the structuring of the first partial layer or first partial layer system, but can itself produce a decorative effect. It is also possible that, for the second partial layer or second partial layer system, several different etch resists, for example resist lacquers with different colorations, may be used to produce further visual effects.

The etching agent used for structuring the first partial layer or first partial layer system depends on the composition of this layer or layer system. For largely opaque metallic layers in particular or transparent or translucent HRI layers (HRI=High Refractive Index) in particular, for example, sodium hydroxide, potassium hydroxide, sodium carbonate, tetramethyl ammonium hydroxide or sodium-ethylenediamine tetraacetate are suitable. Suitable etch resists for such etching agents are based for example on PVC (polyvinyl chloride), polyester resins or acrylates, wherein further film-forming substances such as nitrocellulose can typically be incorporated. The etching can be supported by mechanical agitation, for example by brushing, moving the etching bath or ultrasound treatment. Conventional temperatures for the etching operation are preferably between 15° C. and 75° C.

The structuring of the partial first layer or partial first layer system in step c) can further preferably take place by means of a lift-off method. It is expedient if the partial second layer or partial second layer system is or comprises a washcoat.

In lift-off methods, the washcoat is removed using a solvent. The washcoat must therefore be soluble in the solvent. For reasons of environmental protection, water is preferably used as the solvent. Suitable washcoats are composed for example on the basis of polyvinyl alcohol (PVA) or polyvinylpyrrolidone (PVP) and can additionally contain fillers that facilitate the subsequent removal of the washcoat. The removal of the washcoat takes place in a solvent bath or by spraying with solvent, preferably at temperatures of 15° C. to 65° C. As in the case of etching, the removal of the washcoat can also be supported mechanically, for example by brushing, agitating the solvent bath, spraying or ultrasound treatment.

In areas where the partial first layer or partial first layer system is applied to the washcoat, the partial first layer or partial first layer system is removed together with the washcoat. The partial first layer or partial first layer system therefore remains only in areas in which it does not overlap with the partial second layer or partial second layer system. A negative of the overlapping areas is therefore formed. This is useful in particular when the washcoat is a component of a layer system, so that the remaining components of the layer system that are not removed with the washcoat are arranged accurately in register with the remaining areas of the first layer or first layer system.

The structuring of the partial first layer or partial first layer system in step c) can further preferably take place by mask exposure. The partial second layer or partial second layer system itself therefore acts here as an exposure mask or is structured using a separate exposure mask. It is expedient here if the partial second layer or partial second layer system is or comprises a protective lacquer.

By protective lacquer is meant a substance that absorbs in a wavelength range used for exposing the partial first layer or partial first layer system. During exposure, the partial layers or layer systems are irradiated over the entire surface with light in this wavelength range, preferably perpendicular to the plane of the layer. Wavelengths conventionally used for the exposure are for example 250 nm to 420 nm. The exposure preferably takes place with a dose of 10 mJ/cm$^2$ to 500 mJ/cm$^2$. The exposure times are obtained from the sensitivities of the materials used and the output of the available light source.

Where the partial second layer or partial second layer system is present, therefore, less light of this wavelength reaches the partial first layer or partial first layer system.

It is also possible to combine etch resists and protective lacquers, for example by adding absorbing substances, for example so-called UV absorbers, dyes, color pigments or scattering substances, such as for example titanium dioxide, to an etch resist lacquer.

The protective lacquer is preferably a lacquer that comprises in particular binders, dyes, pigments, in particular colored or non-colored pigments, special-effect pigments, thin-film systems, cholesteric liquid crystals and/or metallic or non-metallic nanoparticles. Suitable protective lacquers are formulated for example on the basis of PVC, polyester or acrylates. Thus, the second partial layer or second partial layer system not only performs a protective function in the structuring of the first partial layer or first partial layer system but can also produce a decorative effect itself. It is also possible that, for the second partial layer or second partial layer system, several different protective lacquers, for example with different colorations, are used to produce further visual effects.

In order to achieve the desired structuring, it is expedient if the partial first layer or partial first layer system is or comprises a photoresist.

During exposure to a specific wavelength range, a photoresist alters its chemical and/or physical properties, so that the different properties of the exposed and unexposed areas can be utilized for the selective removal of the photoresist in one of the areas. For example, when the photoresist is exposed, its solubility changes vis-à-vis a solvent which can be used to develop the photoresist after exposure. In the case of positive photoresists, during the developing step that follows exposure, the exposed area is selectively removed and in the case of negative photoresists, the unexposed area is selectively removed. A photoresist can therefore also act as a washcoat.

Suitable positive photoresists are for example AZ 1518 or AZ 4562 from AZ Electronic Materials based on phenolic resin/diazoquinone. Suitable negative photoresists are for example AZ nLOF 2000 or ma-N 1420 from micro resist technology GmbH based for example on cinnamic acid derivatives. These can preferably be exposed by irradiation with light in a wavelength range of 250 nm to 440 nm. The required dose depends on the respective layer thicknesses, the wavelength of the exposure and the sensitivity of the photoresists.

To develop these photoresists, for example tetramethylammonium hydroxide is suitable. The development preferably takes place at temperatures of 15° C. to 65° C. for a preferred development time of 2 seconds to a few minutes. Here too, the development operation and the associated local removal of the photoresist can again be supported by mechanical agitation, such as for example brushing, wiping, exposure to a flow of the developing medium or ultrasound treatment.

The photoresist can also contain in particular binders, dyes, pigments, in particular colored pigments, special-effect pigments, thin-film systems, cholesteric liquid crystals and/or metallic or non-metallic nanoparticles in order to produce additional decorative effects.

It is further expedient if, in steps a) or b), the partial first layer or partial first layer system and/or the partial second layer or partial second layer system is initially produced over the entire surface or at least over large areas of the surface and is then structured. The production over the entire surface or large areas of the surface can take place for example by printing or vapor deposition.

The subsequent structuring of the partial first layer or partial first layer system and/or of the partial second layer or partial second layer system in steps a) or b) then takes place preferably by etching, lift-off or mask exposure. This takes place analogously to the structuring of the partial first layer or partial first layer system in step c), as described above. The required etch resists, protective lacquers or washcoats can, in turn, be a component of one or both of the layer systems or can be applied as additional layers. These layers can in turn remain as a component of the layer system or can also be removed again in a further step. In the case of mask exposure, an external exposure mask can also be used, which is placed on the respective layer or layer system. However, methods are also possible in which specific areas of the first layer or first layer system are partially removed, for example using a laser. Such methods are suitable in particular for the individual marking of security elements.

It is further possible that, during the structuring of the partial second layer or partial second layer system in step b), the structuring of the partial first layer or partial first layer system according to step c) takes place at the same time. This produces a method that is particularly simple and quick to carry out.

Alternatively, it is also possible that, in step a) and/or b), the partial first layer or partial first layer system and/or the partial second layer or partial second layer system are produced in structured form. For this, a printing method is preferably used, in particular intaglio printing, flexographic printing, offset printing, screen printing or digital printing, in particular ink-jet printing.

Preferably, the partial first layer or partial first layer system is or comprises a reflective layer of in particular an opaque metal and/or in particular a transparent or translucent material with a high refractive index (meaning a high real part of the complex refractive index), and/or at least one single- or multi-colored lacquer layer and/or a Fabry-Perot layer system.

It is further preferred if the partial second layer or partial second layer system is or comprises at least one transparent, translucent or largely opaque single- or multi-colored lacquer layer, in particular an etching and/or protective lacquer, and/or a Fabry-Perot layer system. Through the use or combination of such layers or layer systems for the partial first and second layers or the partial first and second layer systems, a variety of optical effects can be produced, which further contribute to anti-forgery security and provide a particularly attractive optical appearance.

Preferably, the partial first layer or partial first layer system and/or the partial second layer or partial second layer system are applied here in the form of at least one motif, pattern, symbol, image, logo or alphanumeric characters, in particular numbers or letters. The layers or layer systems can also complement one another before or only after the structuring of the partial first layer or partial first layer system to form such a motif, pattern, symbol, image, logo or alphanumeric characters, in particular numbers or letters. A graphic element produced in this way, which is formed by the interaction of several layers, is particularly difficult to reproduce and therefore particularly forgery-proof.

It is further advantageous if the partial first layer or partial first layer system and/or the partial second layer or partial second layer system is applied in the form of a one- or two-dimensional line and/or dot grid. Transformed line grids are also possible here, for example with wavy lines, which can also have a variable line width. The dots in a dot grid can have any geometries and/or sizes and do not have to be in the shape of a circular disc. For example, dot grids of triangular, rectangular, any kind of polygonal or star-shaped dots or dots designed in the form of symbols are also possible. The dot grid can also be made up of dots of different sizes and/or different shapes. Precisely when such a grid interacts with a graphic element in the other layer or in the other layer system, further graphic effects, such as for example half-tone images, can be produced.

The line and/or dot grid here preferably has a grid spacing of less than 300 μm, preferably of less than 200 μm and of more than 25 μm and preferably of more than 50 μm. The grid spacing can also vary across the grid. Line thicknesses or dot diameters are preferably from 25 μm to 150 μm and can also vary. Such grids have an effect on other graphic elements on which the grid is superimposed, but are themselves no longer perceived as such by the naked human eye.

It is also advantageous if the substrate comprises a carrier layer, in particular a film made of a plastic, preferably polyester, in particular PET (polyethylene terephthalate), and/or a release layer, for example of a polymer lacquer, for example PMMA (polymethyl methacrylate) or of waxy substances. Such a carrier layer imparts stability to the multi-layer body during its production and subsequent handling and protects it from damage. A release layer facilitates release of the security element from layers that are not required, such as the carrier layer, so that it can be applied to the desired document or object, in particular in the form of a hot stamping film with the carrier layer as a carrier film and the security element as a transfer ply to be transferred from the carrier film onto a substrate.

The substrate preferably comprises a replication layer with a diffractive surface relief. The replication layer can consist of a thermoplastic, i.e. thermally curing or drying, replication lacquer or a UV-curing replication lacquer or a mixture of such lacquers.

It is advantageous if the surface relief introduced into the replication layer forms an optically variable element, in particular a hologram, Kinegram® or Trustseal®, a preferably sinusoidal diffraction grating, an asymmetrical relief structure, a blazed grating, a preferably isotropic or anisotropic matt structure or a light-diffracting and/or light-refracting and/or light-focusing micro- or nanostructure, a binary or continuous Fresnel lens, a microprism structure, a microlens structure or a combination structure thereof.

Using such structures or combinations thereof, a variety of optical effects can be achieved, which are in addition difficult to imitate and cannot be copied or can be copied only with difficulty using conventional optical copying methods, so that a particularly forgery-proof multi-layer body is obtained.

It is further expedient if, in a further step d), a third layer or third layer system is applied which is or comprises in particular an HRI layer and/or an adhesive layer. Adhesive layers can be used to affix the multi-layer body to a substrate, for example a document to be protected. HRI layers are particularly expedient in connection with extensive flat relief structures which can be made visible through the transparent HRI layer including in areas where the first and/or second layer or the first and/or second layer system do not provide an opaque metalized layer. A suitable material for an HRI layer is for example zinc sulfide or also titanium dioxide or zirconium dioxide.

A multi-layer body obtainable in this way can be used as a security element, in particular for a security document, in particular a bank note, a security, an identity document, a passport or a credit card.

BRIEF DESCRIPTION OF THE DRAWINGS

The invention is illustrated more clearly below by way of example, based on several embodiment examples with the aid of the drawings. There are shown in.

DETAILED DESCRIPTION OF THE INVENTION

Figure 1:
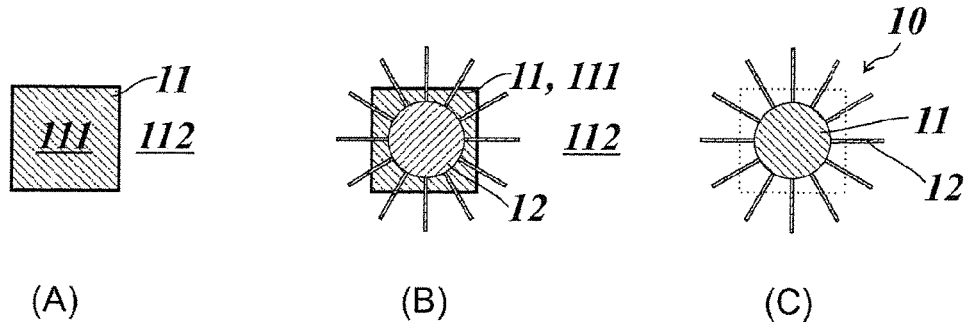
FIG. 1A-C: a multi-layer body and the production steps of a multi-layer body with a metal layer and a single-colored lacquer layer.

FIG. 1 shows a first embodiment example of a multi-layer body 10, which can be used as a security element for bank notes, securities, identity documents, tickets or protected product packaging. The multi-layer body 10 comprises a first layer 11, which is in the form of a metal layer, for example of aluminum, as well as a second layer 12, which is in the form of a colored etch resist lacquer. Besides aluminum, copper, silver or chromium or a wide variety of metal alloys are also suitable.

As FIG. 1*a* shows, to produce the multi-layer body 10 the first layer 11 is initially produced, which can take place for example by vapor deposition on a substrate that is not shown. The vapor deposition preferably takes place in a vacuum by thermal vapor deposition, electron beam vapor deposition or also by sputtering. The layer thickness of the first layer 11 is preferably 5 nm to 100 nm, further preferably 15 nm to 40 nm.

The first vapor-deposited layer can then be partially removed by known methods, for example by the partial application of an etch resist after the vapor deposition and subsequent etching, including removal of the etch resist; by the partial application of a washcoat before the vapor deposition and washing off (lift-off) after the vapor deposition or by partial application of a photoresist after the vapor deposition and subsequent exposure followed by removal of the exposed or unexposed components of the photoresist, depending on the type (positive or negative) of the photoresist.

Alternatively, the substrate is not vapor coated over the entire surface; rather, the layer 11 is partially produced, so that it is present in a first area 111 and not in a second area 112. Various methods of achieving this are known, such as for example screening using a rotating mask or printing of an oil which prevents the deposition of the metal layer in the vapor deposition process.

A replicated diffractive structure, for example in the form of an optically variable element (OVD=optical variable device), in particular a hologram, Kinegram® or Trustseal®, a preferably sinusoidal diffraction grating, an asymmetrical relief structure, a blazed grating, a preferably isotropic or anisotropic matt structure or a light-diffracting and/or light-refracting and/or light-focusing micro- or nanostructure, a binary or continuous Fresnel lens, a microprism structure, a microlens structure or a combination structure thereof, may already have been applied to the substrate beforehand. However, this does not necessarily have to be present.

The first layer 11 also does not have to be continuous, as shown, but can have any structure and any shape.

In the next step, the second layer 12, here in the form of a radial pattern, is printed onto the first layer. Intaglio printing, flexographic printing, offset printing, screen printing or digital printing, in particular ink-jet printing, is preferably used as the printing technique.

The second layer 12 here extends both into the area 111 covered by the first layer 11, but does not completely cover this, and into the area 112 not covered by the first layer 11. Where a replicated diffractive structure is present, the printing preferably takes place in register with this structure, with target tolerances of +/−1 mm, preferably +/−0.5 mm, depending on the printing method.

The lacquer used for printing the second layer 12 is an etch resist, i.e. resistant to an etching agent that can dissolve the metal of the first layer 11. If aluminum is used for the first layer, this etching agent can be for example sodium hydroxide solution. A lacquer based on PVC/PVAc (polyvinyl acetate) copolymer, for example, is then suitable as etch resist.

The lacquer further contains dyes, pigments, in particular colored or non-colored pigments or special-effect pigments, thin-film systems or cholesteric liquid crystals or nanoparticles, so that it produces an optically visible effect.

After the second layer 12 has been printed, the intermediate product shown in FIG. 1*b* is treated with the etching agent described. The etching then takes place preferably at a concentration of 0.1% to 5% and a temperature of the etching agent of 15° C. to 75° C. over a period of 5 seconds to 100 seconds. A suitable etch resist is for example a lacquer based on PVC/PVAc (polyvinyl acetate) copolymer, which is printed on in a layer thickness of preferably 0.1 μm to 10 μm. In the areas not covered by the second layer, the first layer 11 dissolves. The etching can be followed by a rinsing operation, for example with water, and a drying step.

FIG. 1*c* shows the resulting multi-layer body 10 from the side opposite the print side. It can be seen that the structures of the first layer 11 and second layer 12 blend seamlessly into one another, i.e. are arranged accurately in register. This side is also the side from which the multi-layer body 10 is typically viewed. If a replicated diffractive structure is present, the first layer 11 acts as a reflective layer, so that the diffractive structure is particularly clearly visible in the area of the first layer 11. By means of an additional coating with an adhesive layer, which is not shown, the diffractive structure can be completely obliterated in the area 111 not covered by the first layer 11 if the adhesive layer has a similar refractive index (e.g. approximately 1.5) to the replication layer and therefore no optically active barrier layer is formed between adhesive layer and replication layer. The refractive indices of the two adjacent layers should differ from one another by no more than 0.1. The adhesive layer simultaneously serves for the application of the multi-layer body 10 to a substrate, for example a bank note. The color can be designed to be largely transparent or translucent, so that the underlying substrate is visible, but a largely opaque design is also possible.

Instead of a metal layer as first layer 11, several adjoining color layers can also be used, which are printed on the substrate. Suitable lacquers for this purpose are for example photoresists, such as for example AZ 1518 from AZ Electronic Materials. The second layer 12 is then preferably a protective lacquer, for example a transparent or opaque lacquer with a UV blocker. Benzophenone derivatives or highly disperse titanium dioxide are particularly suitable for this purpose. The second layer 12 is then preferably printed overlapping with the border areas of the color layers of the first layer 11. After exposure over the entire surface in a wavelength range of preferably 320 nm to 430 nm, a preferred exposure dose of 10 mJ/cm$^2$ to 500 mJ/cm$^2$ and etching with for example 0.3% NaOH at a preferred temperature of approximately 50° C. for a period of preferably 10 seconds to 30 seconds, only the colored components of the first layer 11 then remain where they were covered by the second layer 12 and thus form a multi-colored decoration. If e.g. the second layer 12 is present in the form of guilloche lines, the finished multi-layer body 10 therefore displays guilloche lines in which color transitions can be seen, i.e. so-called rainbow printing.

Figure 2:
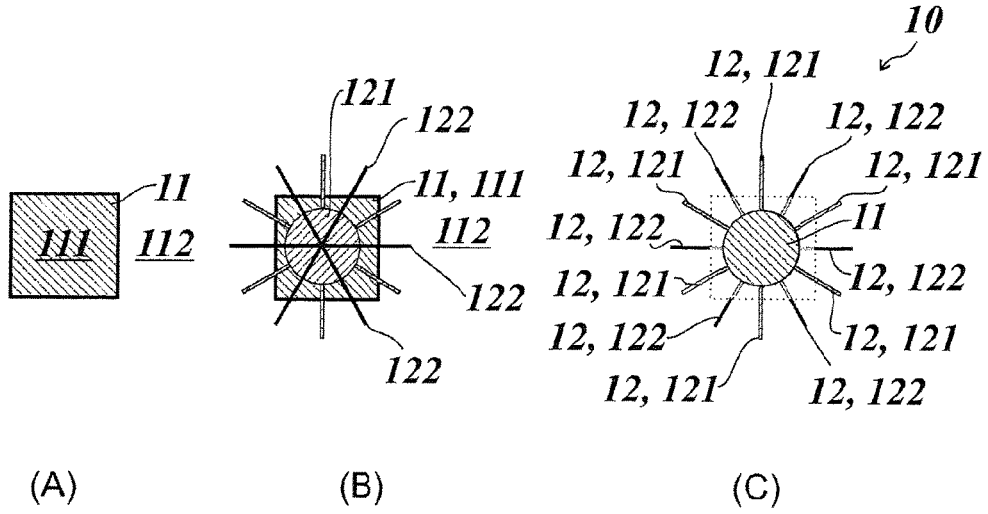
FIG. 2A-C: a multi-layer body and the production steps of a multi-layer body with a metal layer and a two-colored lacquer layer.

The multi-layer body 10 shown in FIG. 2 is produced analogously to FIG. 1. Only in the second production step according to FIG. 2*b*, the second layer 12 is formed as a layer system by printing two different-colored lacquers 121, 122. The two lacquers 121, 122 can overlap in places and are preferably printed in register with a tolerance of preferably less than 0.5 mm and particularly preferably of less than 0.2 mm.

After the etching, which is carried out as described in FIG. 1, the multi-layer body 10 according to FIG. 2*c* is obtained. The rays of the star-shaped motif shown, formed by the second layer 12, now appear alternately in the colors of the lacquers 121, 122. As well as print colors visible in the visible range, here as in the other embodiment examples shown, lacquers can also be used which are UV active or can be excited by IR radiation or display optically variable effects, such as for example OVI® inks, or which are electrically or magnetically detectable, for example by adding appropriate metallic nanoparticles.

Here too, as explained with reference to FIG. 1, a rainbow printing effect can again be created.

Figure 3:
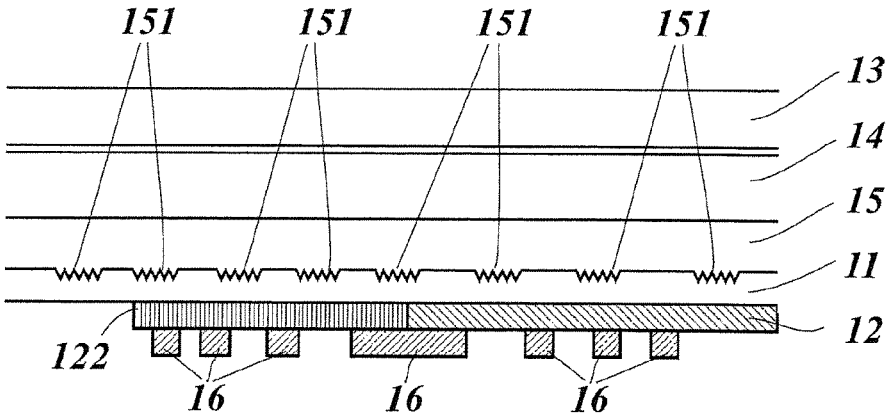
FIG. 3: a sectional view through a first intermediate product in the production of a multi-layer body according to FIG. 2.
Figure 4:
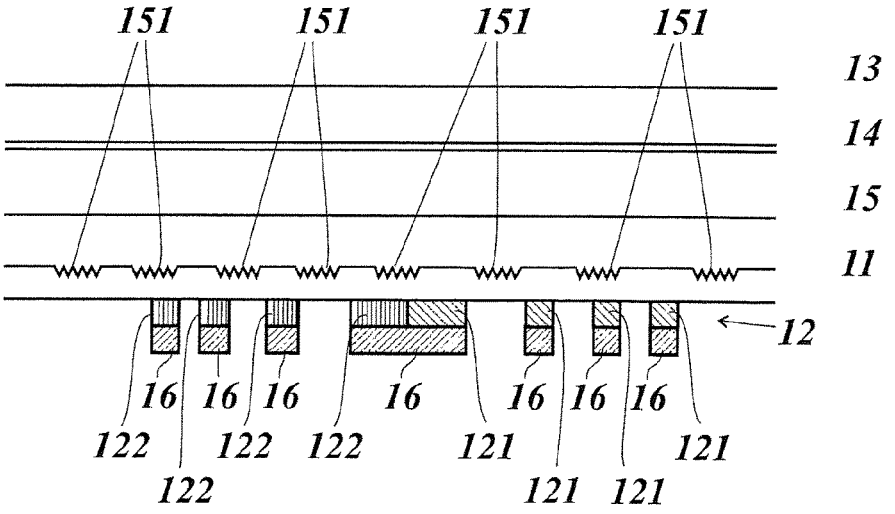
FIG. 4: a sectional view through a second intermediate product in the production of a multi-layer body according to FIG. 2.
Figure 5:
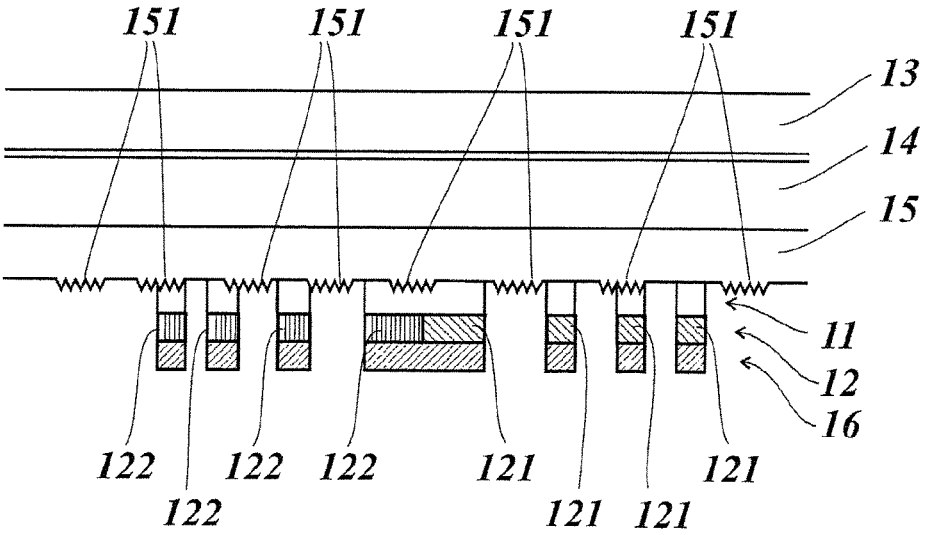
FIG. 5: a sectional view through a third intermediate product in the production of a multi-layer body according to FIG. 2.

FIGS. 3 to 5 show the production steps of an alternative multi-layer body 10, the basic structure of which, however, corresponds to that shown in FIG. 2. The essential difference lies in the fact that the second layer 12 in this case is not already structured when printed, but is first applied over the entire surface or at least in large areas of the surface and is then structured.

For this, a release layer 14 and a replication layer 15 of for example a thermoplastic material or a radiation- or heat-curing replication lacquer are first applied to a carrier layer 13 of polyester, in particular PET, wherein these layers can in turn consist of several plies. In the replication layer 15, diffractive structures 151 are then formed, for example by stamping with a metallic stamping tool. The first layer 11, which in this case is formed as a layer of a transparent highly refractive material (HRI=High Refractive Index), for example of zinc sulfide or titanium dioxide, is then applied to the replication layer 15. The second layer 12, which again consists of two different-colored lacquers 121, 122, which adjoin one another, is then applied to the first layer 11 over the entire surface or at least in large areas of the surface. The lacquers 121, 122 are UV-sensitive photoresists, such as for example AZ 1518 from AZ Electronic Materials based on phenolic resin/diazoquinone. A mask layer 16 is then printed partially onto the second layer 12. The mask layer 16 simultaneously serves as an etching lacquer and a protective lacquer. An etch resist lacquer, for example based on PVC/PVAc (polyvinyl acetate) copolymer, can be provided for example with UV-absorbing titanium dioxide particles or other UV blockers for this. This is followed by exposure to UV light from the side of the mask layer 16. The exposure preferably takes place at a wavelength of 365 nm with a dose of 25 mJ/cm$^2$ to 500 mJ/cm$^2$. The intermediate product shown in FIG. 3 is then exposed to an alkaline bath, which simultaneously functions as a developing and etching bath.

NaOH in a preferred concentration of 0.05% to 2.5%, which preferably acts on the intermediate product for a period of 2 seconds to 60 seconds at a temperature of 20° C. to 65° C., is for example suitable for this.

In the areas not protected by the mask layer 16, the photoresist 121, 122 of the layer 12 was exposed during the UV irradiation and therefore now dissolves in the developing bath. The intermediate product represented in FIG. 4 is obtained. However, this is not isolated. Rather, the etching operation is continued, wherein the HRI layer 11 is now attacked where it is not protected by the remaining layer 12. The lacquers 121, 122 therefore act simultaneously here as an etch resist. After the etching operation, the finished multi-layer body 10 represented in FIG. 5 is obtained. An adhesive layer can also be applied to this, which fills in the exposed diffractive structures 151 where these are not covered by the first layer 11. The diffractive structures 151 are then only visible where the HRI material of the first layer 11 acts as a reflective layer.

Figure 6:
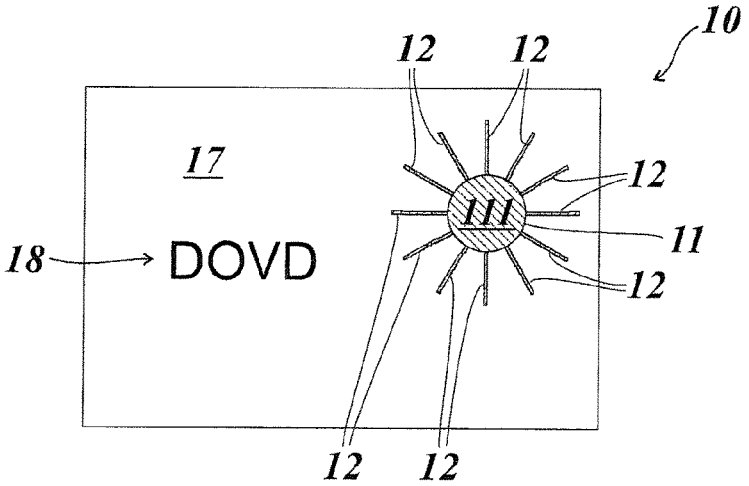
FIG. 6: a multi-layer body with a metal layer, a single-colored lacquer layer, a diffractive structure and an HRI layer.

In FIG. 6, a further multi-layer body 10 is represented. The application of the layers 11 and 12 takes place analogously to the embodiment example shown in FIG. 1. A further transparent HRI layer 17 is then applied over the entire surface, so that a diffractive element 18 not covered by the first layer 11 becomes visible.

Diffractive structures are thus visible in the opaque metallic areas of the first layer 11 and in the areas of the transparent HRI layer 17, but typically not in the printing areas of the second layer 12, because the diffractive structures are obliterated by the colored lacquer of the second layer 12 printed directly onto the diffractive structures, because the colored lacquer preferably has a similar refractive index (approximately 1.5) to the replication layer and therefore no optically active boundary layer is formed between colored lacquer and replication layer. The refractive indices of the two adjacent layers should preferably differ from one another by no more than 0.1.

Figure 7:
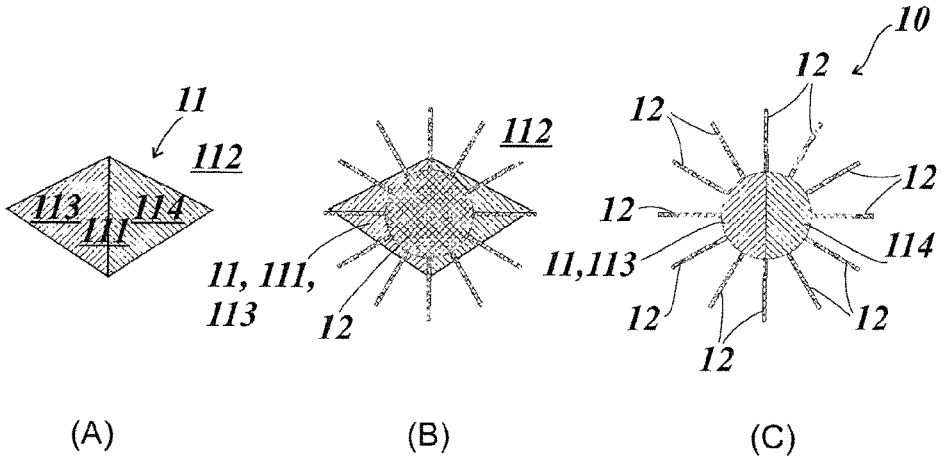
FIG. 7A-C: a multi-layer body and the production steps of a multi-layer body with two metal layers and a single-colored lacquer layer.

The embodiment example according to FIG. 7*a-c* again corresponds to the embodiment example according to FIG. 1. The only difference lies in the fact that, for the first layer 11, two different metals 113, 114, such as for example Al and Cu, are used. The two metals 113, 114 can be spatially separated, adjacent or also partially overlapping.

FIG. 7*b* again shows how the second layer 12 is printed onto the first layer 11, viewed from the printing side.

FIG. 7*c* shows the finished multi-layer body viewed from the metal side. Because of the opaque metal layers, the printing of the layer 12 is not visible under the metal areas of the layer 11.

The structuring of the first layer 11 can take place in two steps since, for example, different etching agents have to be utilized for the two metals or metal alloys used. Where Al and Cu are used for the first layer 11, these are for example NaOH and $FeCl_3$. However, since the same printed mask, namely the second layer 12, is used for the structuring, the transitions of the two metals 113, 114 of the first layer 11 take place in perfect register, in other words in an exact relative position to the printing of the second layer 12.

Figure 8:
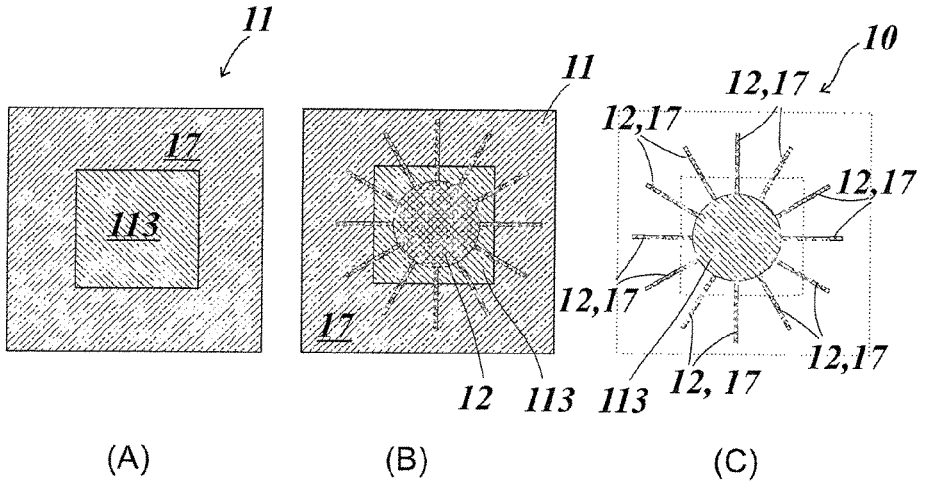
FIG. 8A-C: a multi-layer body and production steps of a multi-layer body with a metal layer, an HRI layer and a single-colored lacquer layer.

The embodiment example according to FIG. 8 again corresponds to the embodiment example according to FIG. 1. In addition, only a further transparent HRI layer 17 is applied. For this, in a first step an opaque metal 113, for example aluminum, is applied in the manner already described. In a further step, the HRI layer 17 of ZnS or $TiO_2$ is applied, which can also take place by vapor deposition or sputtering, so that a layer arrangement according to FIG. 8*a* is present. The HRI layer 17 can likewise be only partially present, can adjoin the metal layer 113 or can also at least partially overlap it. The metal layer 113 and the HRI layer 17 together form the first layer 11.

Overprinting is then carried out with for example a red-colored layer as the second layer 12, so that the situation according to FIG. 8*b* is obtained. The view is from the printing side.

In another process step, the areas of the two reflective layers 113, 17 that have not been overprinted are removed, optionally also in two process steps with chemicals adapted corresponding to the layers to be removed, e.g. two different alkaline solutions. While NaOH can be used to remove the aluminum parts under the conditions described, to remove an HRI layer of ZnS, NaOH or also $Na_2CO_3$ is preferably likewise used at a temperature of 20° C. to 60° C. for a period of 5 seconds to 60 seconds.

The finished multi-layer body is seen in FIG. 8*c* from the side of the first layer 11. Compared with FIG. 1, the effect of the diffractive structures in the substrate is also visible in the non-metallic areas in which the HRI layer 17 is present, while at the same time the colored printing of the second layer 12 is visible because between the print and the diffractive structures the HRI layer 17 is also arranged as an optical boundary layer. The colored lacquer here can be transparent, translucent or else largely opaque.

The embodiment according to FIG. 9 again corresponds to the one according to FIG. 1. The difference lies only in the fact that the first layer 11 is present in finely structured form, here as repetitions of the number "50". The production process comprises a first step, in which the finely structured first layer 11 is produced according to FIG. 9*a*. Correspondingly finely structured metal layers can be produced for example in the following manner: by structuring a photoresist layer by means of a high-resolution mask exposure, which layer is in turn then utilized for structuring the metal layer, or by using a method for tolerance-free partial metalizing as known for example from WO 2006/084685 A2. The layer 11 consists of a fine grid, which consists for example of a microscopically fine text.

The colored printing of the second layer 12 then takes place according to FIG. 9*b*. The second layer 12 in this example is a comparatively coarsely structured motif in the form of the large number "50". However, the second layer 12 can likewise be very finely structured.

In the last step, the colored printing of the layer 12 serves as a mask for the removal of the first layer 11 in accurate register, so that the multi-layer body 10 shown in FIG. 9*c* is obtained. This takes place analogously to the etching methods already described.

If, for example, first layer 11 and second layer 12 are finely structured line grids, depending on their relative position to one another, overlay effects occur and the structure ultimately formed is a finely structured overlay structure of the first layer 11 and second layer 12. The overlay structure can produce for example a desired moiré effect.

The fine structuring of the first layer 11 can also be designed for example as a guilloche of a large number of fine lines, preferably as a metallic reflective layer in combination with optically diffractive structures, for example with a KINEGRAM®, as shown by FIG. 17A.

The colored printing of the second layer 12 then takes place according to FIG. 17B. The colored printing can exhibit several different-colored areas, for example in the form of a national flag (as shown here) and/or a geographic contour of a country or in the form of a coat of arms or of another multi-colored motif.

In the last step, the colored printing of the layer 12 serves as a mask for the removal of the first layer 11 in accurate register, so that the multi-layer body 10 shown in FIG. 17C is obtained. This takes place analogously to the etching methods already described.

Figure 17:
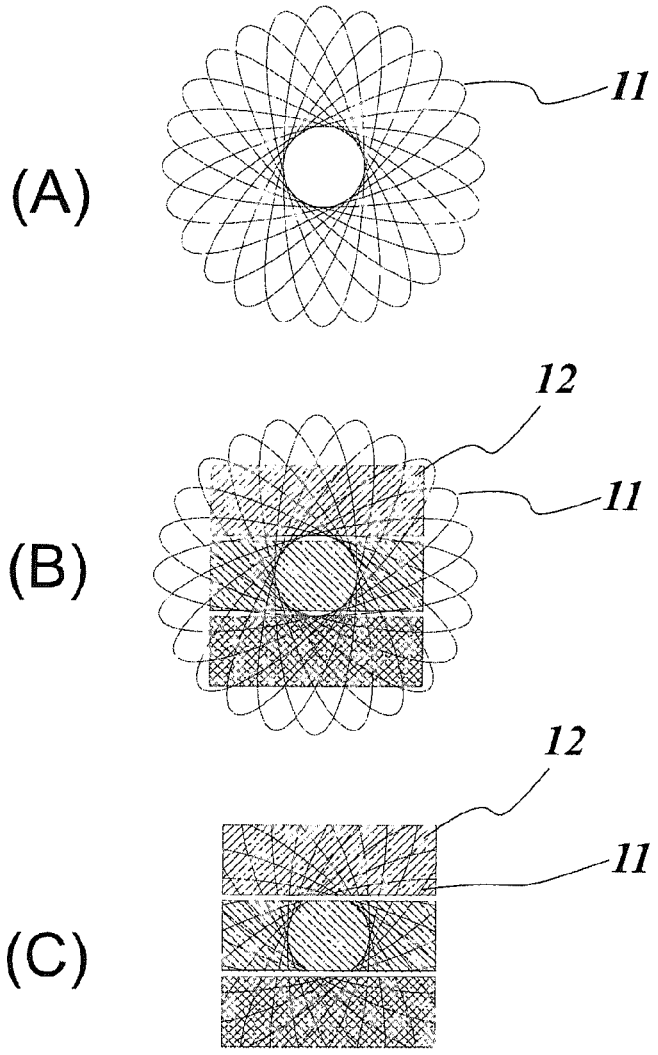
FIG. 17A-C: a multi-layer body and production steps of a multi-layer body with a finely structured metal layer and a multi-colored lacquer layer.

In the embodiment shown in FIG. 17, the observer recognizes as forgery-proof and independent features, the facts that the finely structured lines are present only in the colored areas and that the finely structured lines visible in one colored area continue in register in a further adjacent colored area.

Figure 18:
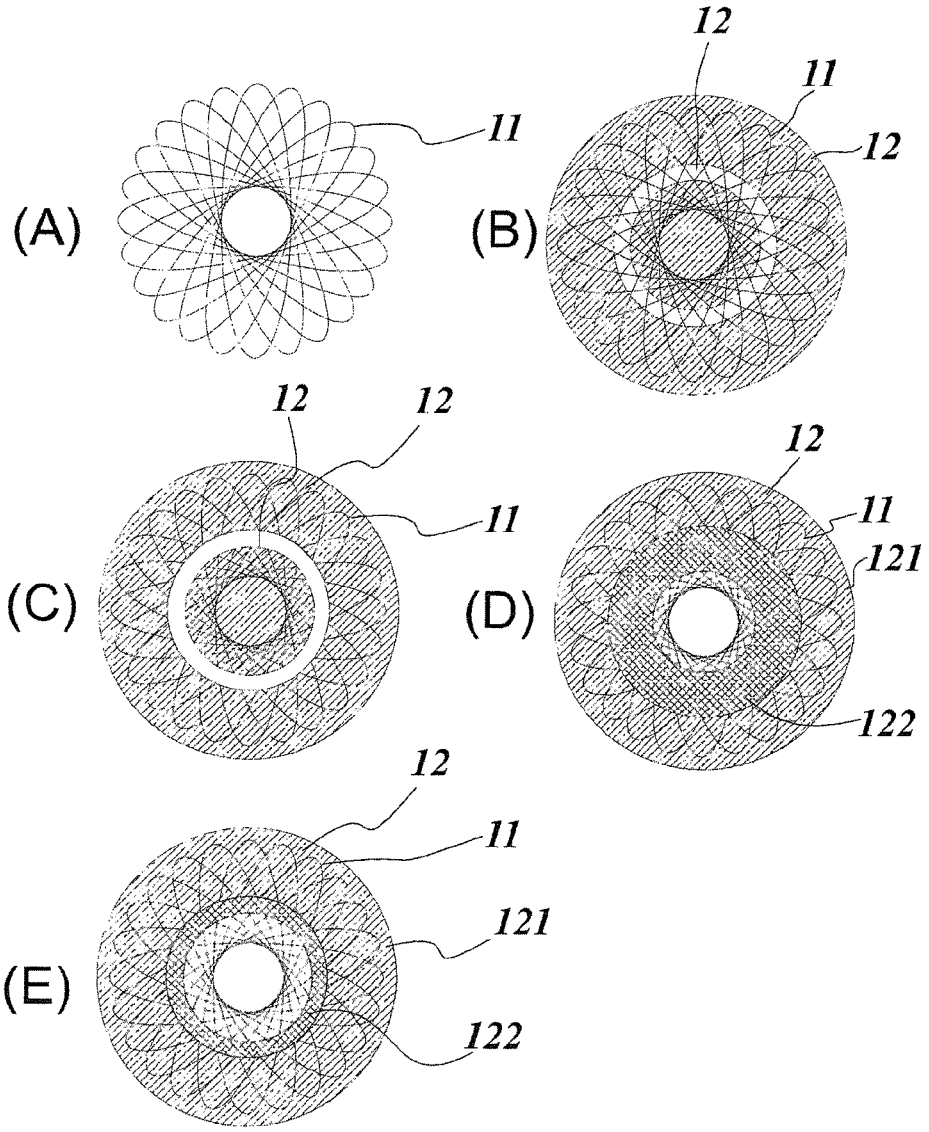
FIG. 18A-E: a multi-layer body and production steps of a multi-layer body with a finely-structured metal layer and a single-colored lacquer layer.

Another embodiment with a finely structured first layer 11 is shown in FIG. 18. Here too, the fine structuring of the first layer 11 can also be designed for example as a guilloche composed of a large number of fine lines, preferably as a metallic reflective layer in combination with optically diffractive structures, for example with a KINEGRAM®, as shown by FIG. 18A.

The printing of the second layer 12 then takes place according to FIG. 18B. A colorless, preferably transparent etch resist with a UV absorber is utilized. This etch resist is then intended to perform a dual function: the etch resist serves on the one hand for the further substructuring of the finely structured first layer 11 by means of etching and on the other hand subsequently as an exposure mask for structuring a colored area.

Corresponding to the surface of the first layer 11 coated with etch resist, the fine structure of the first layer 11 is removed by means of etching in the areas where the etch resist is not provided.

A colored photoresist is then printed on, which comprises at least the area that is not covered by the colorless etch resist. The photoresist can also, however, overlap with the etch resist. By exposure of the colored photoresist using the colorless etch resist with the UV absorber as an exposure mask, the colored photoresist is cured in those areas that do not have any transparent etch resist and can be removed in the other areas in accurate register with the etch resist and with the areas of the finely structured first layer 11 that are protected and defined by the etch resist.

In the embodiment shown in FIG. 18, the observer recognizes as forgery-proof and independent features the facts that the fine structures of the first layer 11 are only present in the colorless areas and end in accurate register with the colored area of the photoresist, and that the fine structures of the first layer 11 virtually continue "over the colored area" in an adjacent transparent area while remaining in register.

Figure 9:
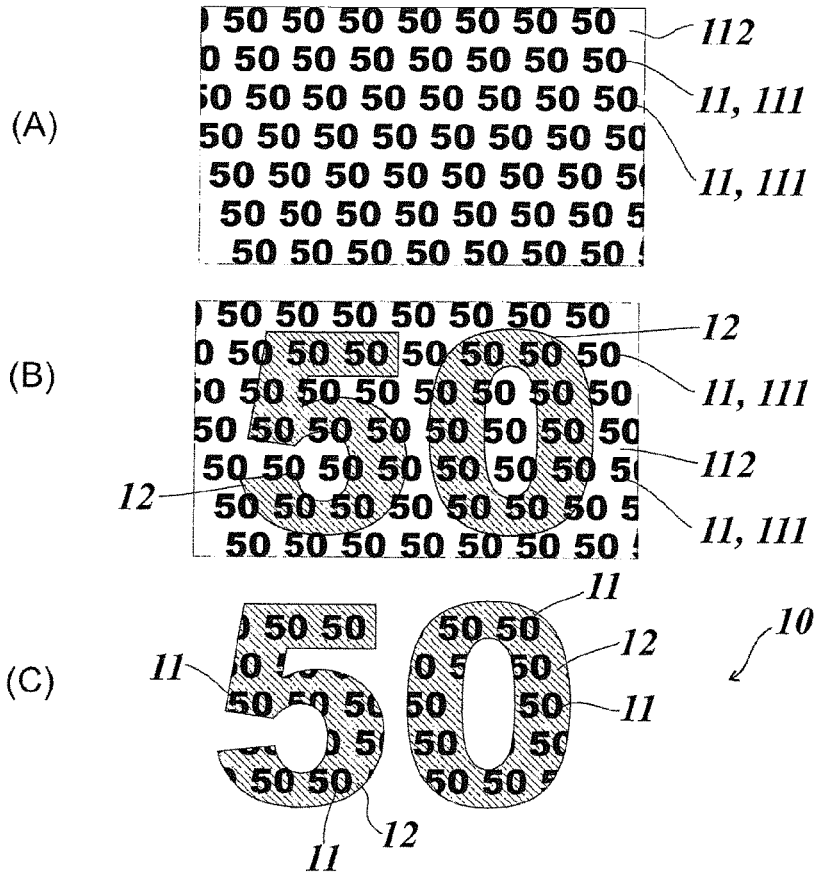
FIG. 9A-C: a multi-layer body and production steps of a multi-layer body with a finely structured metal layer and a single-colored lacquer layer.
Figure 10:
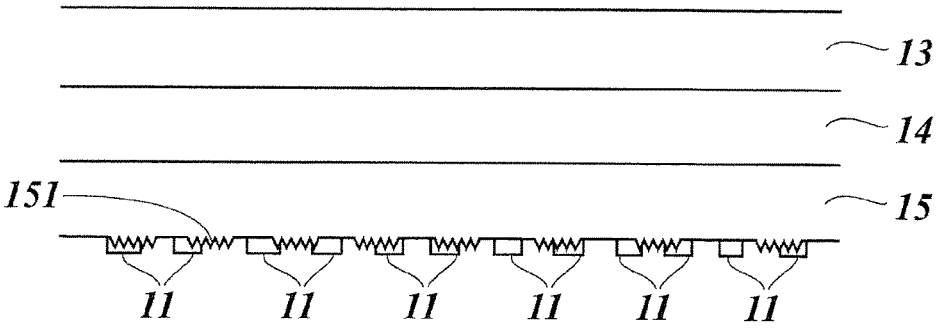
FIG. 10: a sectional view through a first intermediate product in the production of a multi-layer body according to FIG. 9.

FIGS. 10 to 13 show the production steps of an alternative multi-layer body 10, which, however, corresponds in its basic structure to that shown in FIG. 9. The essential difference lies in the fact that the second layer 12 in this case is not already structured when printed, but is first applied over the entire area or at least in large areas and is then structured.

For this, a release layer 14 and a replication layer 15 are initially applied to a carrier layer 13 of polyester or PET. Diffractive structures 151 are then formed in the replication layer 15. The first layer 11, which in this case is present as a finely structured metal layer, for example in the form of a grid, is then applied to the replication layer 15.

Figure 11:
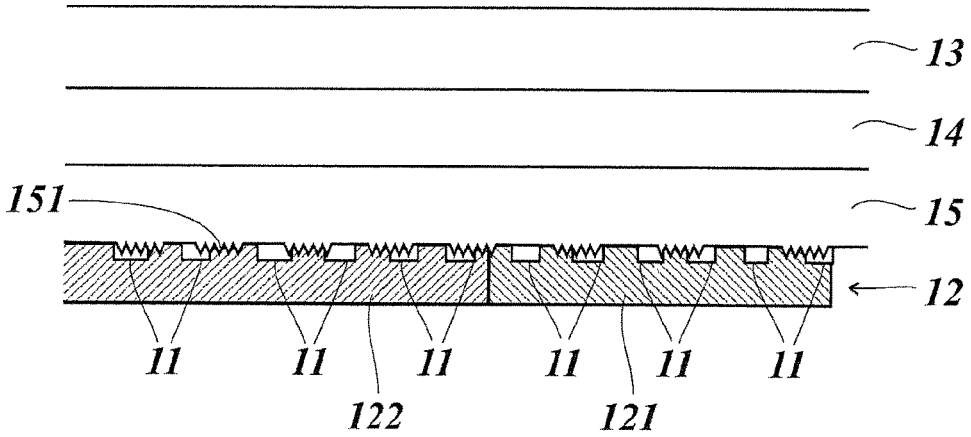
FIG. 11: a sectional view through a second intermediate product in the production of a multi-layer body according to FIG. 9.
Figure 12:
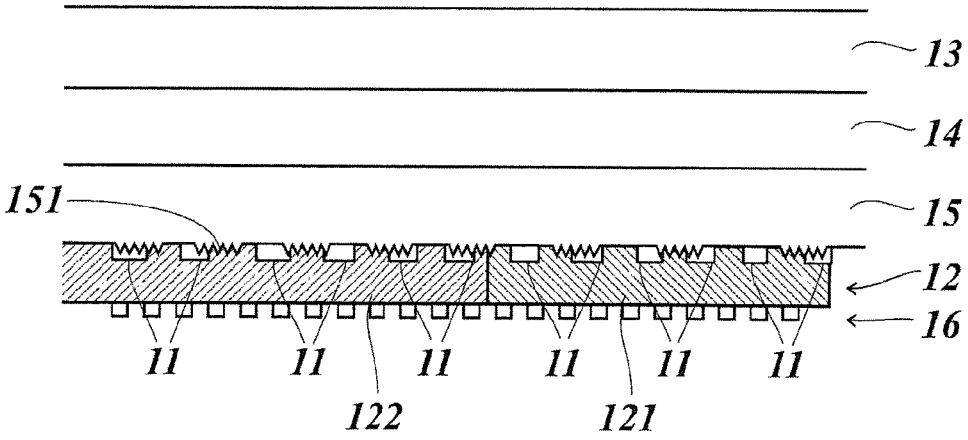
FIG. 12: a sectional view through a third intermediate product in the production of a multi-layer body according to FIG. 9.

As shown in FIG. 11, the second layer 12, which again consists of two different-colored lacquers 121, 122, which adjoin one another, is then applied to the first layer 11 over the entire surface. The lacquers 121, 122 are UV-sensitive colored photoresists. A mask layer 16 is then printed partially onto the second layer 12 so that the intermediate product represented in FIG. 12 is obtained. The mask layer 16 can take the form of a further grid. The mask layer 16 simultaneously serves as an etching lacquer and a protective lacquer. For this, an etch resist lacquer can be provided for example with UV-absorbing titanium dioxide particles or other UV blockers. This is followed by exposure to UV light from the side of the mask layer 16. The exposure parameters and lacquers used correspond to those already described above.

Instead of a mask layer 16, a film mask can also be utilized which lies in contact with the layers 121 and 122 only during the exposure process and is then removed again.

Figure 13:
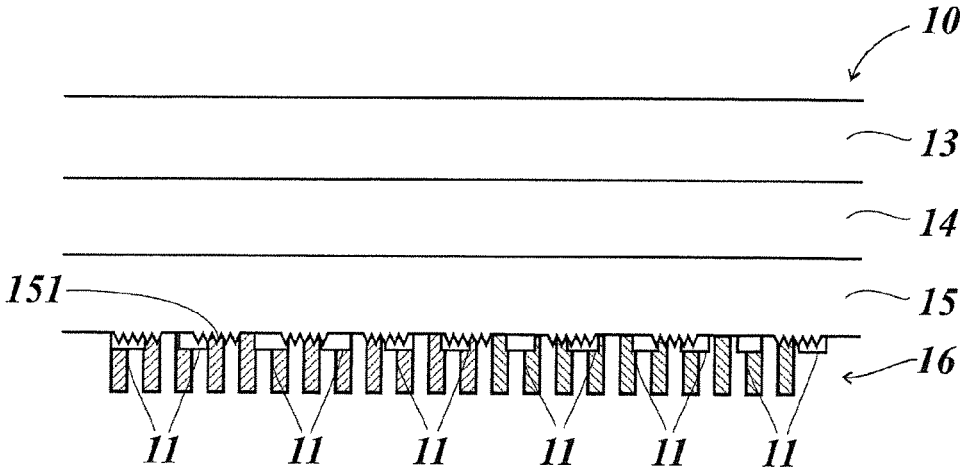
FIG. 13: a sectional view through the finished multi-layer body according to FIG. 9.

The intermediate product shown in FIG. 12 is then exposed to an alkaline bath, for example 0.3% NaOH at 50° C., which simultaneously functions as a developing and etching bath. In the areas not protected by the mask layer 16, the photoresist 121, 122 of the layer 12 was exposed during the UV irradiation and therefore it now dissolves in the developing bath. In the further course of the etching operation, the first layer 11 is attacked where it is not protected by the remaining layer 12. The lacquers 121, 122 therefore simultaneously act as an etch resist here. After the etching operation, the finished multi-layer body 10 represented in FIG. 13 is obtained.

Figure 14:
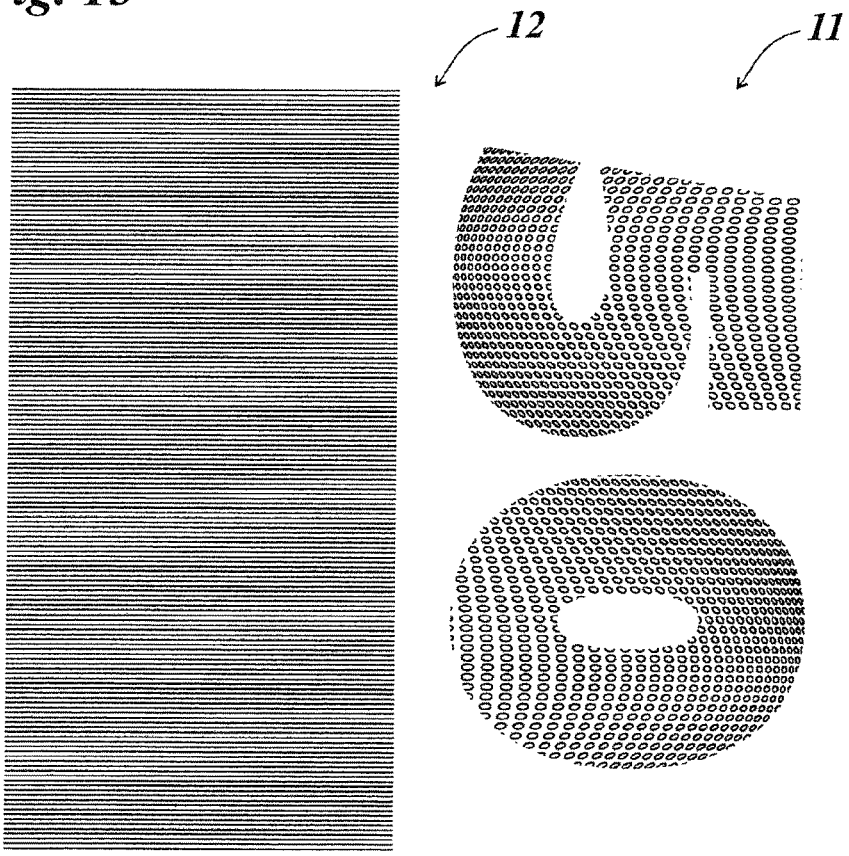
FIG. 14 a detailed view of the structures for the metal and lacquer layer for the multi-layer body according to FIG. 9.

Examples of possible gridded forms of the first layer 11 and the second layer 12 are shown in FIG. 14. Apart from the line and motif grids shown, other structures, for example dot grids, are of course also possible. Furthermore, the first layer 11 and/or the second layer 12 can be provided with a further grid of diffractive structures on the respective replication layer of the first and/or second layer. This can result not only in overlay effects through the overlaying of the fine grids of the first and second layers 11, 12, but also a further, additional overlaying with the diffractive grid or grids of the first and/or second layer or their optically variable effects. The overlay effects can prove very different depending on how similar or different the grid spacings and/or grid shapes of the grids involved in the overlay are. In particular, the viewing angle and/or lighting angle dependency of the diffractive grids can lead to surprising optical effects in this complex overlay.

The embodiment examples discussed up to now are based on the fact that a partial reflective layer of opaque metal or transparent HRI material (first layer 11) is first produced and then a print (second layer 12) is applied. The print of the second layer 12 serves as a mask layer, for example analogous to an etch resist print, for the further structuring of the partial metal layer 11.

Figure 15:
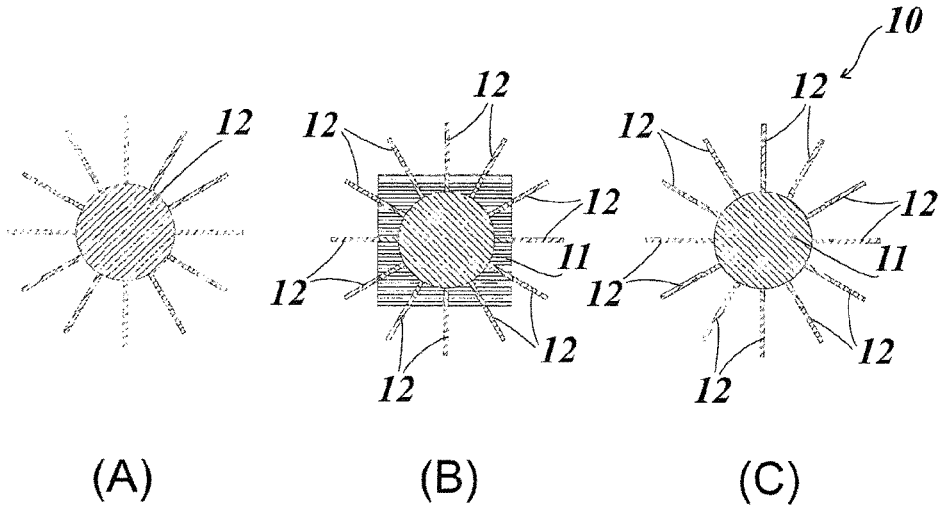
FIG. 15A-C: a multi-layer body and production steps of a multi-layer body with a metal layer and a lacquer layer on the front.

In the embodiment example according to FIG. 15, a print (second layer 12) is first introduced into the input material, into which material a diffractive structure that is not represented is then formed (see FIG. 15*a*).

In a further step, a first partial metal area (first layer 11) is produced, as represented in FIG. 15*b*.

In the next step, the print that is already present in the input material is utilized as an exposure mask for a photoresist layer applied thereon in order to structure the first layer 11 in perfect register with the print of the second layer 12. The materials and process parameters used correspond to those already described above.

The second layer 12 is therefore produced completely independently of the first layer 11 in terms of time and location. The second layer 12 can also, for example, be arranged on the reverse of the substrate, which is not shown, and the first layer 11 on the front thereof. For specific purposes, the second layer 12 could optionally be removed when it has served its purpose as a structuring aid for the first layer 11.

In top view, therefore, both colored metallic areas with the diffractive structures and only colored areas with no diffractive effect can be recognized, wherein these areas, corresponding to the layers 11, 12, blend into one another in perfect register.

Figure 16:
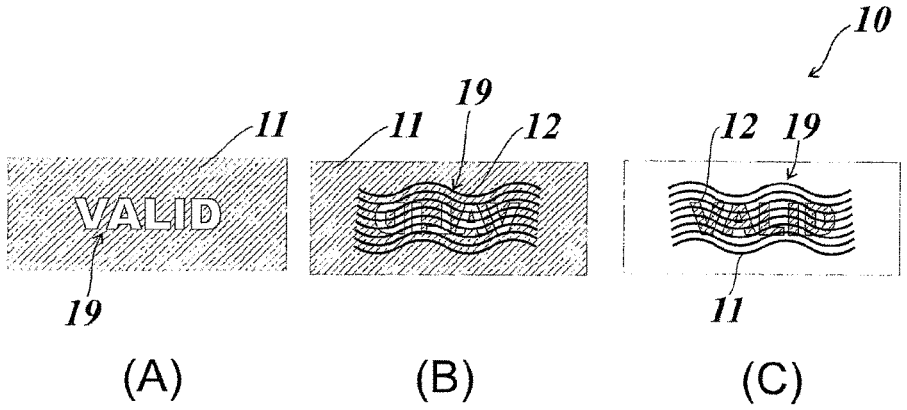
FIG. 16A-C: a multi-layer body and production steps of a multi-layer body with a gridded metal and lacquer layer.

FIG. 16 shows a further alternative embodiment example of a multi-layer body 10. Here, as shown in FIG. 16*a*, the first layer 11 is first produced as a metal layer with recessed lettering 19. The second layer 12, as illustrated in FIG. 16*b*, is printed as a gridded wavy lacquer layer onto the first layer 11 and then serves as an etch resist mask for the further structuring of the first layer 11 in an alkaline bath. After the etching, the multi-layer body 10 shown in FIG. 16*c* is obtained, in which the colored lines of the second layer 12 in the area of the recessed lettering continue in perfect register with the remaining metallic lines of the first layer 11 outside the lettering 19.

The line widths do not have to be constant but can additionally be modulated, resulting in different local surface densities of the grid, forming an additional piece of information. The line widths are preferably from 25 μm to 150 μm. The grid spacing can also be modulated and is preferably less than 300 μm and preferably less than 200 μm, and preferably more than 25 μm.

The invention claimed is:

1. A method for producing a multi-layer body comprising the following steps:

a) producing a partial first layer or partial first layer system on a substrate, wherein the partial first layer or partial first layer system is present in a first partial area and not in a second partial area;

b) producing a partial second layer or partial second layer system, wherein the partial second layer or partial second layer system is present in a third partial area and not in a fourth partial area, and wherein the third partial area overlaps with the first and second partial areas; and c) structuring the partial first layer or partial first layer system using the partial second layer or partial second layer system as a mask.

2. The method according to claim 1, wherein the structuring of the partial first layer or partial first layer system in step c) takes place by etching.

3. The method according to claim 2, wherein the partial second layer or partial second layer system is an etch resist, or at least comprises an etch resist.

4. The method according to claim 3, wherein the etch resist is a lacquer that comprises binders, colored or non-colored pigments and/or special-effect pigments, thin-film systems, cholesteric liquid crystals, dyes and/or metallic or non-metallic nanoparticles.

5. The method according to claim 1, wherein the structuring of the partial first layer or partial first layer system in step c) takes place by lift-off.

6. The method according to claim 5, wherein the partial second layer or partial second layer system is a washcoat that is soluble in water, or at least comprises such a washcoat.

7. The method according to claim 6, wherein the washcoat is a lacquer that comprises binders and fillers.

8. The method according to claim 1, wherein the structuring of the partial first layer or partial first layer system in step c) takes place by mask exposure.

9. The method according to claim 8, wherein the partial second layer or partial second layer system is a protective lacquer or at least comprises a protective lacquer.

10. The method according to claim 8, wherein the partial first layer or partial first layer system is a photoresist or at least comprises a photoresist, wherein the protective lacquer is a washcoat that is soluble in water.

11. The method according to claim 9, wherein the protective lacquer and/or photoresist is a lacquer that comprises binders, colored or non-colored pigments and/or special-effect pigments, thin-film systems, cholesteric liquid crystals, dyes and/or metallic or non-metallic nanoparticles.

12. The method according to claim 1, wherein, in steps a) and/or b) the partial first layer or partial first layer system and/or the partial second layer or partial second layer system is first produced over the entire surface or at least in large areas of the surface and is then structured.

13. The method according to claim 12, wherein the structuring of the partial first layer or partial first layer system and/or of the partial second layer or partial second layer system in steps a) or b) takes place by etching, lift-off or mask exposure.

14. The method according to claim 13, wherein, during the structuring of the partial second layer or partial second layer system in step b), the structuring of the partial first layer or partial first layer system according to step c) takes place simultaneously.

15. The method according to claim 1, wherein, in step a) and/or b), the partial first layer or partial first layer system and/or the partial second layer or partial second layer system is produced in structured form.

16. The method according to claim 15, wherein the partial first layer or partial first layer system and/or the partial second layer or partial second layer system are produced by intaglio printing, flexographic printing, offset printing, screen printing, digital printing, or ink-jet printing.

17. The method according to claim 1, wherein the partial first layer comprises a reflective layer of a metal.

18. The method according to claim 1, wherein the partial second layer comprises at least one single-colored lacquer layer.

19. The method according to claim 1, wherein the partial first layer is applied in the form of at least one motif, pattern, symbol, image, logo or alphanumeric characters, numbers and/or letters.

20. The method according to claim 1, wherein the partial first layer or partial first layer system and/or the partial second layer or partial second layer system is applied in the form of a one- or two-dimensional line and/or dot grid.

21. The method according to claim 20, wherein the line and/or dot grid has a grid spacing of less than 300 μm, and of more than 25 μm.

22. The method according to claim 1, wherein the substrate comprises a carrier layer comprising polyester or PET (polyethylene terephthalate) and/or a release layer.

23. The method according to claim 1, wherein the substrate comprises a replication layer with a diffractive surface relief or the substrate itself is designed as a replication layer.

24. The method according to claim 23, wherein the surface relief introduced into the replication layer forms an optically variable element, a hologram, a sinusoidal diffraction grating, an asymmetrical relief structure, a blazed grating, an isotropic or anisotropic matt structure, or a light-diffracting and/or light-refracting and/or light-focusing micro- or nanostructure, a binary or continuous Fresnel lens, a microprism structure or a combination structure thereof.

25. The method according to claim 1, wherein, in a further step d), a third layer or a third layer system is applied, which is or comprises an HRI layer and/or an adhesive layer.

* * * * *